US007958596B2

(12) United States Patent
Torno

(10) Patent No.: US 7,958,596 B2
(45) Date of Patent: Jun. 14, 2011

(54) ROTARY BROOM WITH VACUUM DUST CONTROL

(75) Inventor: Randall Craig Torno, Ann Arbor, MI (US)

(73) Assignee: Paladin Brands Group, Inc., Cedar Rapids, IA (US)

( * ) Notice: Subject to any disclaimer, the term of this patent is extended or adjusted under 35 U.S.C. 154(b) by 0 days.

(21) Appl. No.: 12/325,626

(22) Filed: Dec. 1, 2008

(65) Prior Publication Data

US 2009/0070954 A1 Mar. 19, 2009

Related U.S. Application Data

(63) Continuation of application No. 11/487,844, filed on Jul. 17, 2006.

(51) Int. Cl.
*E01H 1/08* (2006.01)

(52) U.S. Cl. ..... 15/340.1; 15/340.3; 15/342

(58) Field of Classification Search ..... 15/340.3, 15/342

See application file for complete search history.

(56) References Cited

U.S. PATENT DOCUMENTS

| | | | | |
|---|---|---|---|---|
| 3,568,232 | A | 3/1971 | Swanson | |
| 3,866,541 | A | 2/1975 | O'Connor et al. | |
| 3,879,789 | A | 4/1975 | Kasper | |
| 4,011,624 | A | 3/1977 | Proett | |
| 4,200,953 | A | 5/1980 | Overton | |
| 4,373,322 | A | 2/1983 | Beisel | |
| 4,376,358 | A | 3/1983 | Shelton | |
| 4,580,312 | A | 4/1986 | Van Raaij | |
| 4,819,676 | A * | 4/1989 | Blehert et al. | 134/21 |
| 4,895,476 | A | 1/1990 | Vangaever | |
| 4,979,260 | A | 12/1990 | Holsten et al. | |
| 5,002,595 | A | 3/1991 | Kehr | |
| 5,054,150 | A | 10/1991 | Best et al. | |
| 5,171,124 | A | 12/1992 | Foster | |
| 5,226,757 | A | 7/1993 | Tarrant | |
| 5,369,832 | A | 12/1994 | Hagger | |
| 5,560,065 | A | 10/1996 | Young | |
| 5,771,532 | A | 6/1998 | Munnoch | |
| 5,924,155 | A | 7/1999 | Broz | |
| 6,016,584 | A | 1/2000 | Melroe | |

(Continued)

OTHER PUBLICATIONS

Melroe Manufacturing Company, Owner's Manual Melroe Bobcat Pickup Sweeper M-662 and Pick-Up Sweeper Model M562, brochure, Melroe Manufacturing Company, 5 pages.

(Continued)

*Primary Examiner* — Joseph J Hail, III
*Assistant Examiner* — Shantese McDonald
(74) *Attorney, Agent, or Firm* — Reinhart Boerner Van Deuren P.C.

(57) ABSTRACT

A vacuum assembly module mountable to a work machine attachment for providing dust-reducing capabilities is provided. The vacuum assembly module is a self-supported unit and can be mountable to work machine attachments such as rotary brooms, cold planers, and the like to retrofit the attachment with dust-reducing capabilities. The vacuum assembly module includes a central frame that provides an air flow passage. The central frame supports a filter and a fan within the air flow passage. A fan motor operably drives the fan to draw air through the air flow passage and filter. The fan motor is operably connected to an auxiliary power source, such as a work machine. An optional vibrator may be included for operably shaking and dislodging debris from the filter. The vacuum assembly module may be attached to a debris collecting bin to form a vacuum having a hose.

16 Claims, 9 Drawing Sheets

U.S. PATENT DOCUMENTS

| | | | | |
|---|---|---|---|---|
| 6,354,081 | B1 | 3/2002 | Burton | |
| 6,365,039 | B1 | 4/2002 | Henkin et al. | |
| 6,470,605 | B1 | 10/2002 | Gilman et al. | |
| 6,571,421 | B1 | 6/2003 | Sham et al. | |
| 6,615,849 | B1 | 9/2003 | Gilman et al. | |
| 6,662,881 | B2 | 12/2003 | Domann | |
| 6,687,939 | B1 | 2/2004 | Koester | |
| 6,830,114 | B2 | 12/2004 | Hammonds | |
| 6,839,934 | B2 | 1/2005 | Houghton et al. | |
| 7,086,118 | B2 | 8/2006 | Engel et al. | |
| 7,302,734 | B2 | 12/2007 | Nowak et al. | |
| 7,386,916 | B2 | 6/2008 | Bone | |
| 7,415,748 | B1 * | 8/2008 | Guhr et al. | 15/340.1 |
| 2002/0040513 | A1 | 4/2002 | Franklin et al. | |
| 2003/0037984 | A1 * | 2/2003 | McPherson et al. | 180/311 |
| 2003/0182748 | A1 | 10/2003 | Watts | |
| 2004/0045123 | A1 | 3/2004 | Engel et al. | |
| 2004/0143928 | A1 | 7/2004 | Engel et al. | |
| 2005/0102778 | A1 | 5/2005 | Gregerson | |
| 2006/0048332 | A1 | 3/2006 | Engel et al. | |
| 2006/0053582 | A1 | 3/2006 | Engel et al. | |
| 2006/0182591 | A1 * | 8/2006 | Hackett et al. | 414/685 |
| 2008/0010775 | A1 | 1/2008 | Torno | |
| 2008/0085163 | A1 | 4/2008 | Maybury | |
| 2009/0070954 | A1 | 3/2009 | Torno | |

OTHER PUBLICATIONS

Mastersweep, Convert Your Forklift into a Powerful Sweeping Machine, brochure, Mastersweep manufactured by: GT Mfg., Inc., 2 pages.

Elgin, PM10 Industrial Pelican 3 Wheel Broom Waterless Dust, brochure, Elgin Sweeper Company, Jan. 2005, 3 pages.

Sweepster, Sweepster Pick-Up Sweeper Model HBA, brochure, Sweepster, Apr. 2000, 2 pages.

Sweepster, Sweepster Pick-Up Sweeper Model SB, brochure, Sweepster, Apr. 2000, 2 pages.

Sweepster, Sweepster Big Dawg Collector Sweeper Model BDC, brochure, Sweepster, ISO 9001, Mar. 2002, 2 pages.

Sam Spazzatrici Industriali E Urbane, Sam's Sweeper 604/BV, Commercial Announcement, S.A.M. salute ambientale S.r.l., 2 pages.

Minuteman International, Inc., PowerBoss® Armadillo and Minuteman PowerBoss® Badger, website, http://www.minutemanintl.com/powerboss/rsp_armadillos.html, date last visited Aug. 24, 2006, 2 pages.

* cited by examiner

ROTARY BROOM WITH VACUUM DUST CONTROL

CROSS-REFERENCE TO RELATED PATENT APPLICATIONS

This patent application is a continuation of co-pending U.S. patent application Ser. No. 11/487,844, filed Jul. 17, 2006 the teachings and disclosure of which is hereby incorporated in its entirety by reference thereto.

FIELD OF THE INVENTION

This invention generally relates to vehicular work machines, and more particularly to attachments for work machines.

BACKGROUND OF THE INVENTION

Work machines such as skid steer loaders are a commonly used vehicle for many industrial, agricultural, and landscaping operations. A skid steer loader is typically a relatively small four wheel vehicle which is steered by braking or driving two wheels on one side of the vehicle, while reversely driving the wheels on the other side of the vehicle. Two laterally spaced loader arms are mounted to the vehicle and swing upwardly and downwardly. When the arms are down, their forward ends extend downwardly in front of the vehicle.

A number of attachments can be coupled to the ends of the loader arms to adapt the skid steer to many different types of applications. For example, a bucket is commonly provided to dig, dump, and transport materials such as dirt, sand, gravel or debris. Similarly, the skid steer can be adapted through various attachments to act as a forklift, back hoe, ground preparatory device, cold planer, hole driller, and the like.

In order for the skid steer to clean and sweep a given surface, an attachment known as a rotary broom attachment, also commonly referred to as a bucket sweeper, can be attached to a bucket coupled to the loader arms. The rotary broom attachment includes a housing that is pivotally attached to the bucket and a brush mounted for rotation within the housing. With the arms lowered, and the skid steer moving across a surface, the brush engages dirt or other debris and forces it into the bucket. The bucket acts as a collection bin for the swept debris. The arms can then be raised and the bucket can be pivoted downward to allow the collected debris to be dumped at an appropriate location.

Unfortunately, as the brush cleans and sweeps an area, large quantities of dust can be generated by the sweeping action. The dust makes it difficult to operate the machine by limiting visibility and more importantly is a nuisance and a possible hazard to the operator. A typical method of controlling airborne particulates is to spray the area to be swept with a mist of water just ahead of the brush's path. The damp material coagulates reducing the amount of airborne particulates. Unfortunately, this requires an additional water tank to be mounted to the skid steer or the rotary broom attachment which adds weight to the device. Additionally, the constant use of water prohibits extended periods of operation because the tank sizes are limited to reduce the amount of weight of the rotary broom attachment. When the water tank runs empty, this causes unnecessary downtime and depending on the type of the water source and the water source's location, the downtime can be quite substantial. Furthermore, if no source is available at the jobsite, water must be transported to the jobsite. Additionally, many current rotary broom attachments are not equipped with any dust-reducing devices.

It is important to understand that while skid steer loaders are identified herein as the predominate vehicle to which this invention is directed, it can be employed with equal effectiveness to other types of vehicles having vertically or arcuately movable loader arms or connection devices such as tractors with three point hitches.

BRIEF SUMMARY OF THE INVENTION

One aspect of the present invention is directed toward a substantially self-supported dust-reducing vacuum assembly module for attaching to new attachments or alternatively retrofitting existing work machine attachments, particularly rotary broom attachments. The vacuum assembly module includes a frame structure having an air flow passage extending between an inlet and an outlet. A filter supported by the frame structure is arranged relative to the air flow passage to remove dust from air passing through the air flow passage. A fan supported by the frame structure moves air through the air flow passage and the filter. A motor supported by the frame structure drives the fan. The frame structure, the fan, the filter and the motor, together, form a self-supported module apart from the work machine and apart from the work machine attachment. The self-supported module is mountable to a housing of the work machine attachment.

It is another aspect of the present invention to provide a rotary broom attachment having improved dust-reducing capabilities in the form of a vacuum assembly that can be operably vibrated to partially clean the vacuum assembly without removing the filter of the vacuum assembly. The rotary broom attachment includes a broom assembly releasably attachable to a bucket of a work machine. The broom assembly having a housing and a brush. The brush being rotatably mounted and positioned within the housing such that it protrudes through an opening in the bottom of the housing for sweeping debris into the bucket as the work machine moves across a surface with the broom attachment in a lowered position. A first motor operably coupled to the brush drives the brush. Bucket mounts pivotally and releasably attach the broom attachment to the bucket of the work machine. The housing has a cover portion adapted to cover the bucket and is matable with the bucket to form a collection bin when the rotary broom attachment is attached to the bucket. The rotary broom attachment further includes a vacuum assembly having a frame structure mounted to the housing. The frame structure has an air flow passage extending between an inlet and an outlet. The inlet is in fluid communication with the interior of the housing. A filter is positioned between the inlet and the outlet. A fan, driven by a motor, moves air through the filter. A vibrator operably shakes the filter to dislodge filtered debris from the filter.

Yet another aspect of the invention is directed toward a work attachment for work machines having a vacuum assembly providing improved dust reduction capabilities. The work attachment includes a housing having a release coupling to releasably couple the work attachment to the work machine. A work implement is carried by the housing and is driven by a motor powered by a power source of the work machine. Power transmission lines having quick connect connectors connect the motor to the power source of the work machine. The work attachment includes a vacuum assembly including an air flow passage extending between an inlet and an outlet. The inlet is in fluid communication with an interior of the housing. A fan driven by a motor moves air from the interior through the air flow passage. The motor is connected to a power source of the work machine by power transmission lines having quick connect connectors. Furthermore, a filter is releasably secured within the air flow passage to filter air moved through the air flow passage by the fan.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
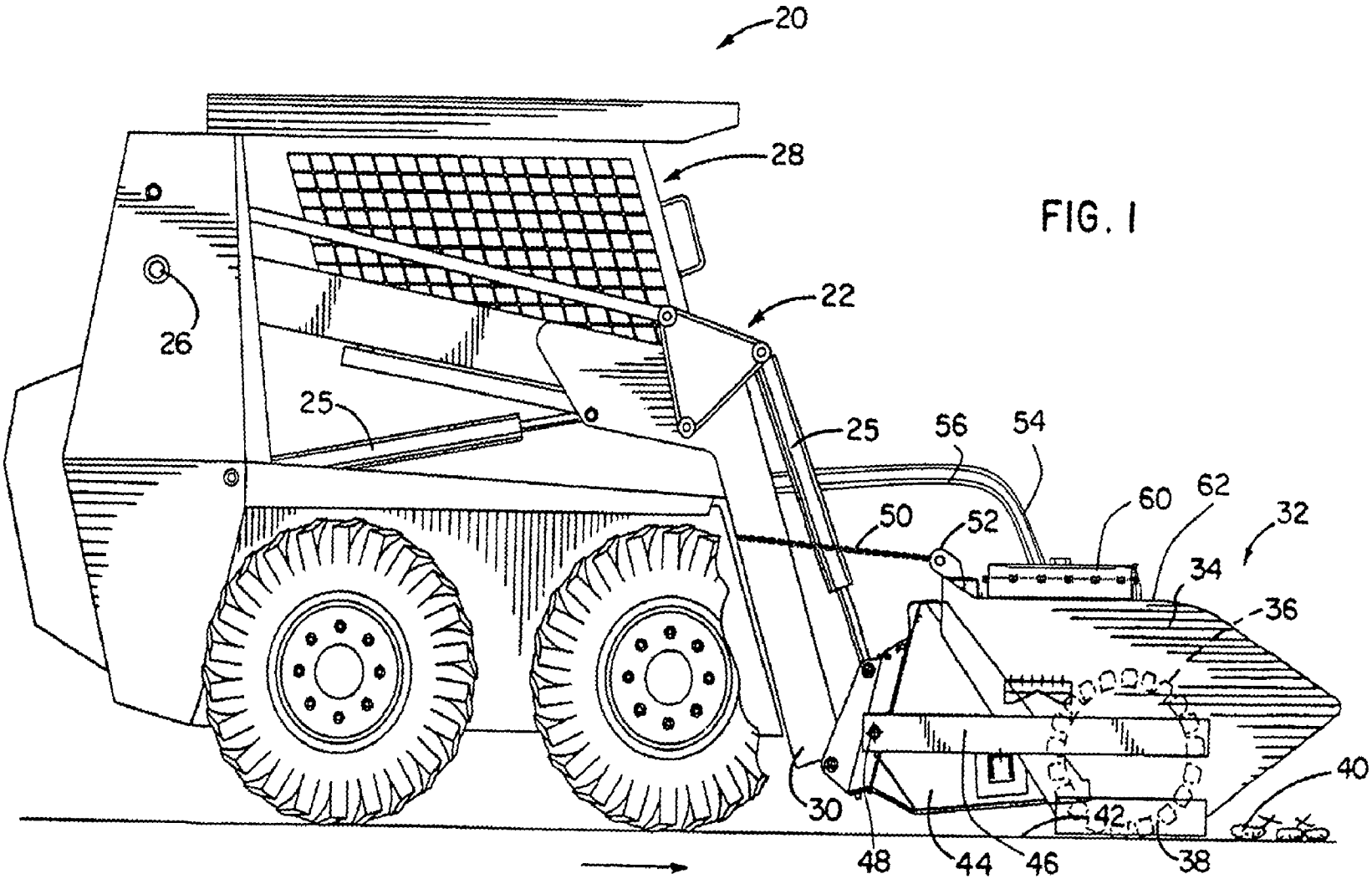
FIG. 1 is a side view of an exemplary embodiment of a rotary broom attachment attached to a skid steer work machine, the rotary broom attachment including a vacuum assembly module constructed in accordance with the teachings of the present invention.

Referring now to the drawings, FIG. 1 illustrates that the present invention generally relates to utility work vehicles such as loader vehicles or tractors, and particularly loader vehicles known as skid steers. The skid steer 20 is adapted and selectively configurable for use in many industrial, agricultural and landscaping applications wherein easy maneuverability, powerful lifting and transporting capabilities are required. As illustrated, the skid steer 20 is provided with a pair of laterally spaced loader arms 22 adapted for arcuate travel by way of hydraulic cylinders 25. As is conventional, the loader arms 22 are pivotally attached to the skid steer 20 at rearward pivots 26. Furthermore, the skid steer 20 is provided with an operator cabin 28. It is to be understood that the present invention will most commonly be employed in conjunction with skid steer loaders, but could also be used in conjunction with other loader type work machines.

A variety of attachments can be attached to the loader arms 22 toward the free end 30 to tailor the skid steer 20 to a range of different industrial, agricultural, landscaping or other applications. U.S. Pat. No. 5,171,124 to Phillip W. Foster and U.S. Pat. No. 5,924,155 to John J. Broz, disclose a few of the typical applications for such a skid steer, the teachings and disclosures of which are expressly incorporated herein by reference thereto. Other attachments or implements for a skid steer include forklifts, ground preparatory tools, cold planers, augers for drilling holes, and the like.

FIG. 1 illustrates a rotary broom attachment 32. As shown, the rotary broom attachment 32 includes a broom housing 34 having a brush 36 mounted for rotation therein. The broom housing 34 is provided with an open bottom 38, such that the brush 36 protrudes downward from the broom housing 34 and can engage debris 40 provided on a surface 42 over which the skid steer 20 travels. The rotating brush 36 forces the debris 40 into the bucket 44 as the skid steer 20 moves across the surface 42. In this embodiment, the bucket 44 of the skid steer 20 forms a collection bin for the debris 40 collected while cleaning the surface 42. The broom housing 34 is positioned relative to and works in conjunction with the bucket 44 to facilitate depositing the debris 40 into the bucket 44 and substantially forms a cover over the bucket 44 further establishing a collection bin. In an alternative embodiment of a rotary broom attachment, the broom attachment includes a dedicated debris collection bin connected to the broom housing. In this embodiment, the bucket of the skid steer is not used at all and the collected debris is collected in the dedicated debris collection bin. The dedicated debris collection bin can be positioned between the brush and the skid steer, or in front of the brush such that the brush is positioned between the skid steer and the debris collection bin. Furthermore, the dedicated debris collection bin can be in the form of a bucket connected to the broom housing for facilitating emptying collected debris from the debris collection bin.

Figure 2:
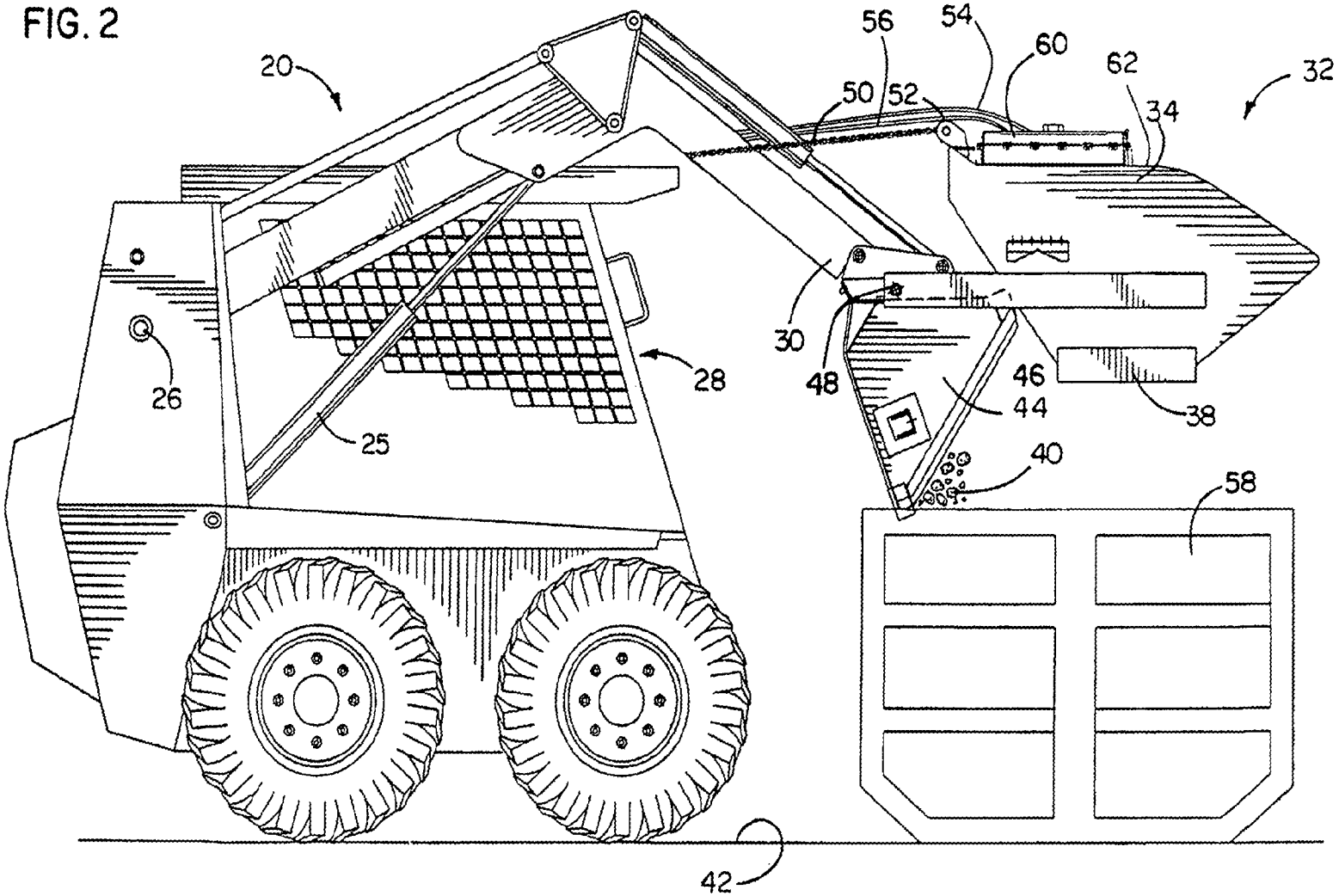
FIG. 2 is a side view of the skid steer work machine of FIG. 1 wherein the bucket is tipped and pivoted relative to the work machine and the rotary broom attachment to empty the bucket of collected debris.

The rotary broom attachment 32 includes bucket mounts for pivotally connecting the rotary broom attachment 32 to the bucket 44 of the skid steer 20. In the illustrated embodiment, the bucket mounts are in the form of brackets 46. The brackets 46 extend rearwardly from the broom housing 34 and pivotally connect to the bucket 44 at pivot 48. Pivot 48 is preferably in the form of a removable pin such that the rotary broom attachment 32 may be selectively and easily attached and detached from the bucket 44. The pivoting connection between the bucket 44 and the rotary broom attachment 32 allows the bucket 44 to be tipped and emptied without having to disconnect the rotary broom attachment 32 from the bucket 44, as is illustrated in FIG. 2. Chains 50 connected between upper chain mounts 52 of the broom housing 34 and the loader arms 22 stabilize the rotary broom attachment 32 during dumping. While the bucket 44 tips to dump debris 40 into container 58, the chains 50 remain taught preventing the rotary broom attachment 32 from falling or tilting. However, the bucket mounts for pivotally connecting the rotary broom attachment 32 to the bucket 44 and/or the arms 22 of the skid steer 20 may take other forms. For example, U.S. Pat. No. 5,369,832 to Hagger teaches and discloses another bucket mount for pivotally connecting the rotary broom attachment to the bucket such that the bucket includes a pair of hooks that engage a pair of mounting pins of the broom housing, and is expressly incorporated in its entirety by reference thereto.

Figure 3:
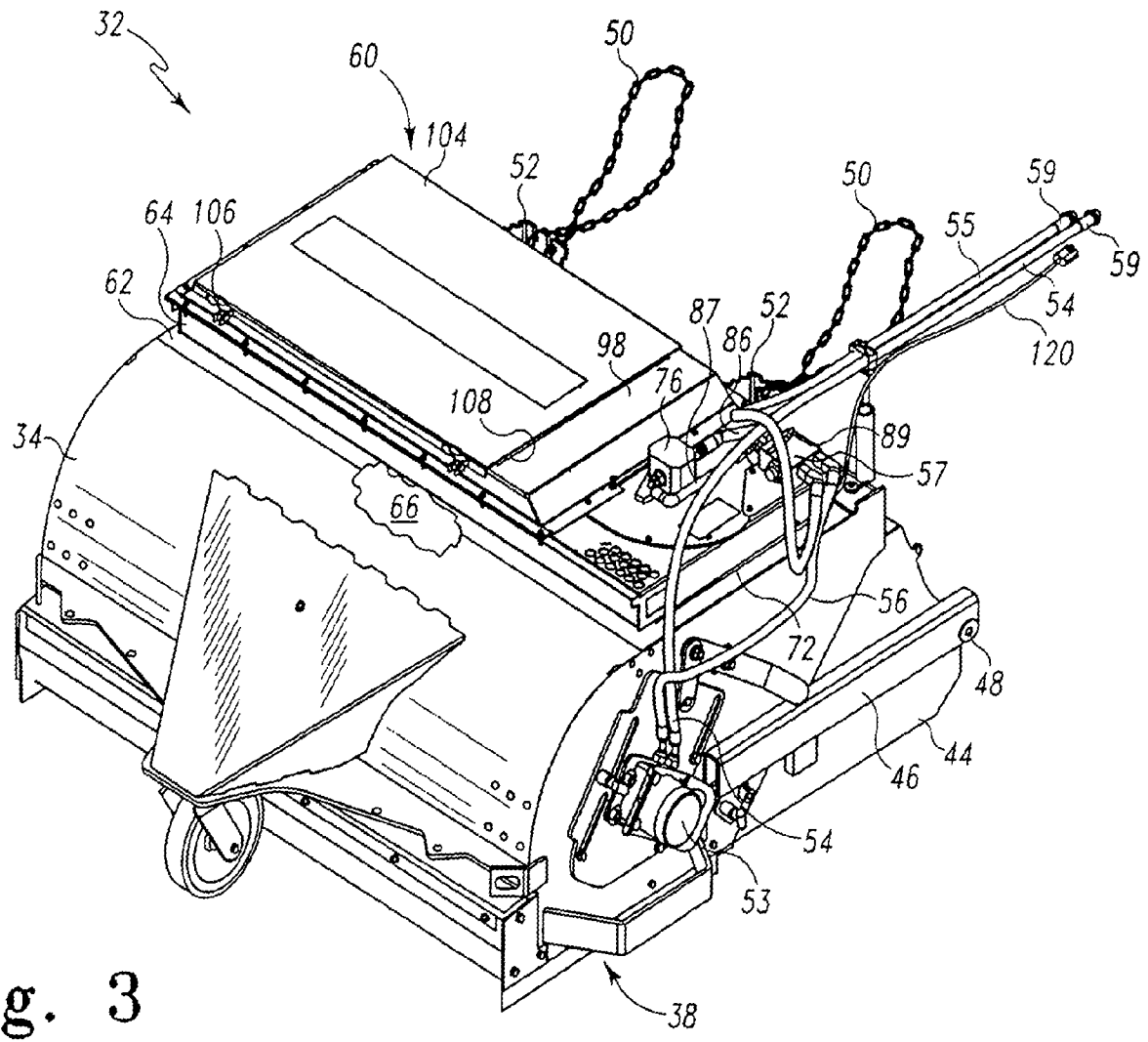
FIG. 3 is a perspective view of a rotary broom attachment constructed in accordance with the present invention having a vacuum assembly module attached thereto.

As is shown in FIG. 3, the rotary broom attachment 32 includes a brush motor 53 for operably driving the brush 36 (see FIG. 1). The brush motor 53 can be any suitable motor but is preferably powered by an auxiliary power source of the skid steer 20 such as a hydraulic, a pneumatic, or an electric system of the skid steer 20 that provides sufficient power to operate the brush motor 53 and the brush 36. Preferably, the brush motor 53 is a hydraulic motor as most skid steers and other similar work machines have auxiliary hydraulic power sources designed to power and operate similar attachments. The auxiliary power source is shown schematically in FIG. 7 as a hydraulic system and is identified by reference numeral 200. In an embodiment, the hydraulic auxiliary power source may take the form of a reversible auxiliary power source. In the illustrated embodiment, a combination of three hydraulic power transmission lines (e.g. hoses) 54, 55, 56 and a flow splitting manifold 57 couple the brush motor 53 to the power source of the skid steer 20. Particularly, power transmission lines 54, 55 connect to the skid steer 20, while the third power transmission line 56 (e.g. a hose) connects the brush motor 53 to the flow splitting manifold 57.

The flow splitting manifold 57 separates a single power source output of the skid steer 20 into two outputs for powering two different hydraulic devices. With respect to the illustrated embodiment, the flow splitting manifold 57 allows both the brush motor 53 and a fan motor 76 of a vacuum assembly module 60 to be simultaneously powered, even if a single power source output is provided, as will be more fully described below. Preferably, the flow splitting manifold 57 is a three-way, flow splitting, directional control valve. However, any sufficient device to split the flow of the output may be used.

As the rotary broom attachment 32 is an attachment for a skid steer 20 that may be frequently attached and detached therefrom, power transmission lines 54, 55 include connectors 59 for connecting the power transmission lines 54, 55 to the auxiliary power source output of the skid steer 20. The connectors 59 can be any connector suitable for the auxiliary power system; preferably, the connectors 59 are quick connect connectors for quick, easy and clean connection and disconnection of the power transmission lines 54, 55 to and from the skid steer.

Turning now to an aspect of the present invention, FIG. 1 illustrates a vacuum assembly module 60 mounted to the top 62 of the broom housing 34 of the rotary broom attachment 32. The vacuum assembly module 60 filters dust and airborne particulate from the air that is created by the rotary broom attachment 32 while sweeping and cleaning a surface 42. The present invention will be primarily described with reference to a rotary broom attachment 32. However, the present invention may be used in conjunction with other work machine attachments.

As is best illustrated and described with reference to FIGS. 3-6, an embodiment of the present invention is a self-contained and/or self-supported module or unit having all of the components of the vacuum assembly module 60 supported or carried by a central frame 64. Being a self-contained and/or self-supported module is very beneficial because the vacuum assembly module 60 can be easily used for many applications. Specifically, the vacuum assembly module 60 can be used to retrofit a preexisting rotary broom attachment 32 with dust reduction capabilities. Similarly, by allowing the vacuum assembly module 60 to be a self-contained unit, the units may be mass produced and then ordered as an add-on option to new production rotary broom attachments rather than having to be integrally incorporated into the rotary broom attachment during manufacture.

With the vacuum assembly module 60 attached to the top 62 of the broom housing 34, the vacuum assembly module 60 may be activated to draw dust filled air from the interior 66 of the broom housing 34 and through a filter 68. In an embodiment, the filter 68 is pleated filter media preferably including or having a polymer coating such as polytetrafluoroethylene (PTFE), known commercially as Teflon®, that allows the filter to be easily washed or rinsed and then reused. However, filters having paper media or that are disposable may also be used. As dirty air passes through the filter 68, as illustrated by arrow 81 of FIG. 6, the air is substantially cleaned. The clean air is then exhausted from the vacuum assembly module 60, as will be more fully explained below.

Figure 4:
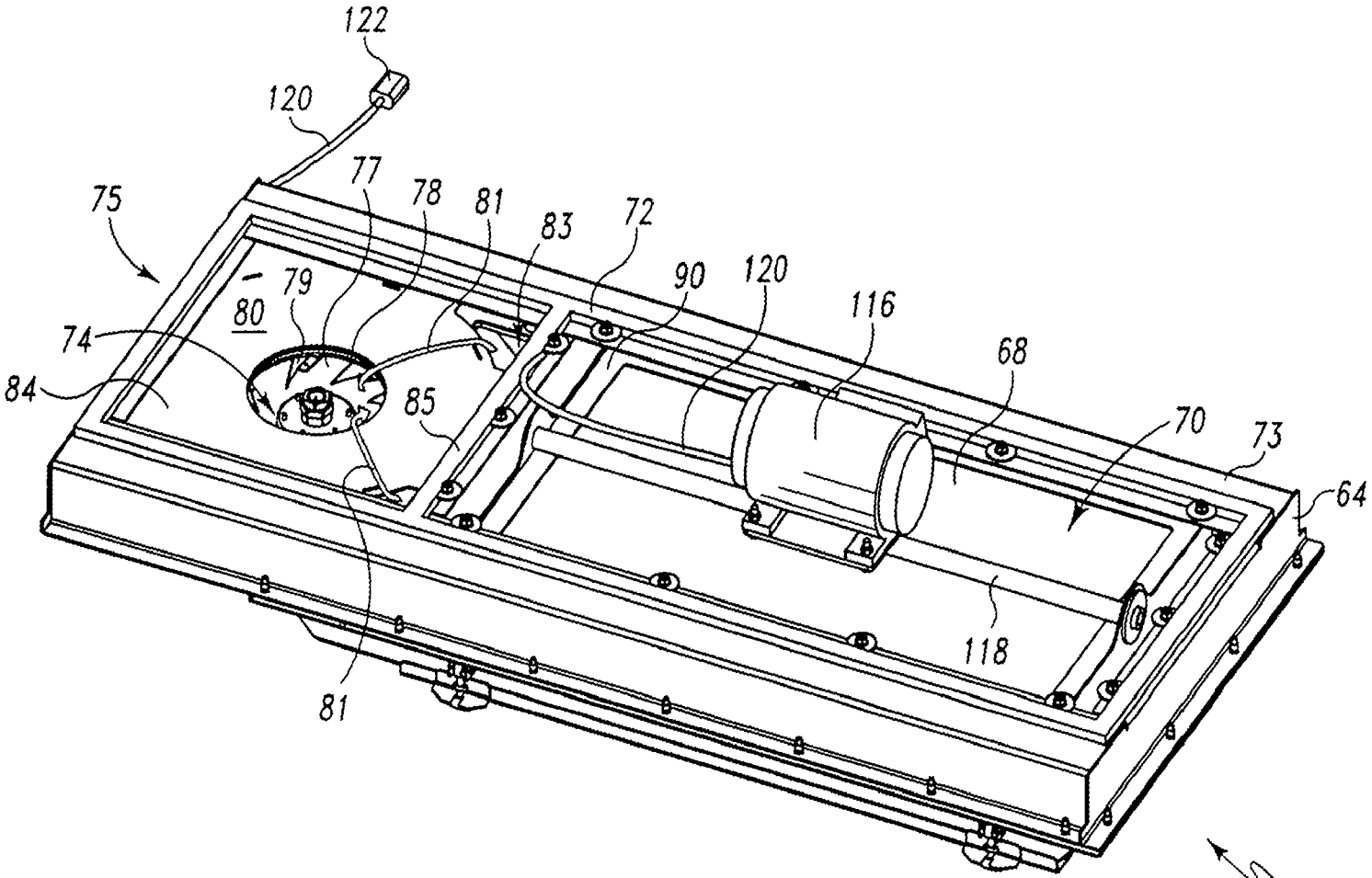
FIG. 4 is a bottom perspective view of the bottom of the vacuum assembly module.
Figure 5:
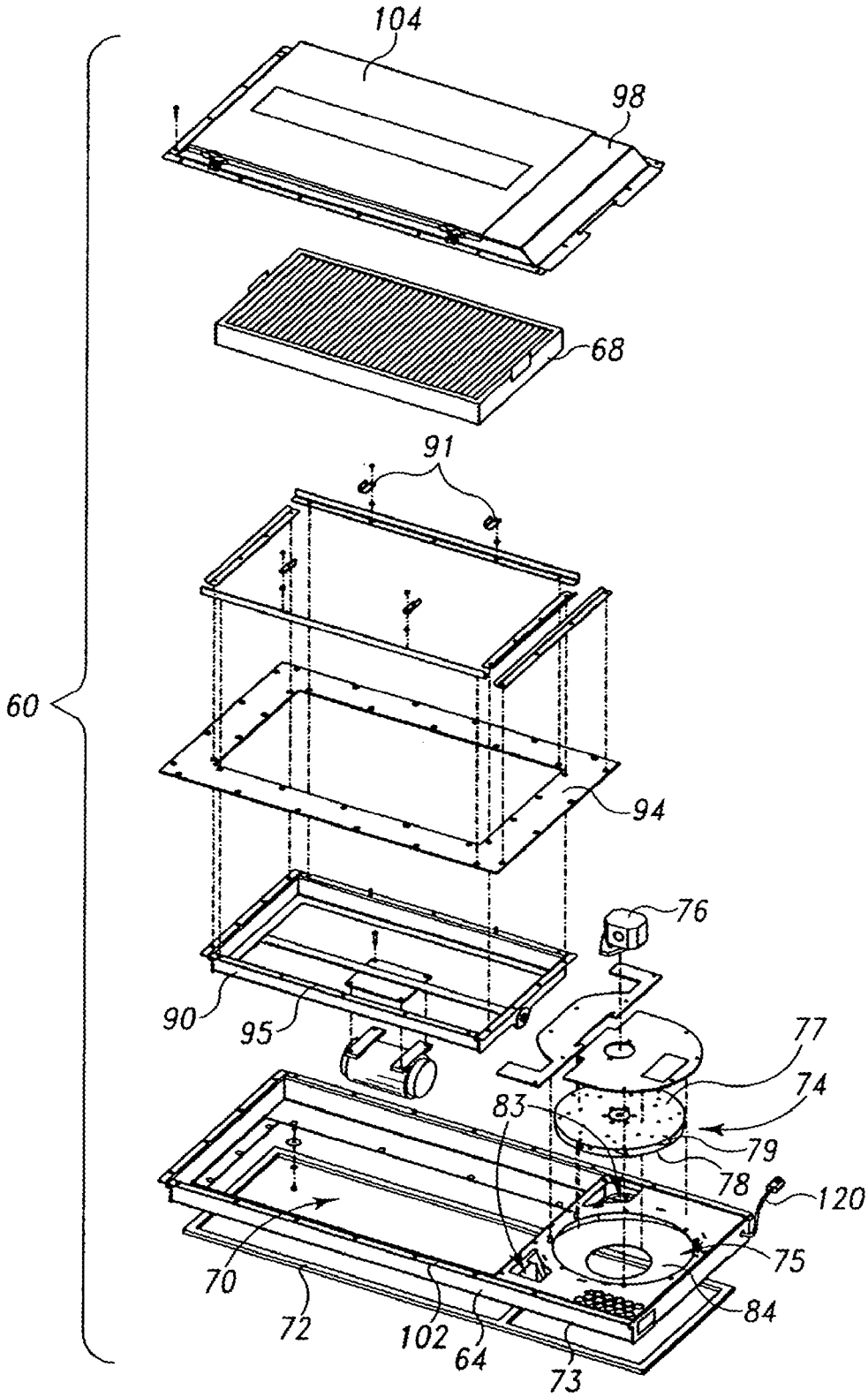
FIG. 5 is an exploded assembly illustration of an embodiment of a vacuum assembly module in accordance with the present invention.

Air enters the vacuum assembly module 60 through an inlet 70 in the form of an opening in the bottom 73 of the central frame 64, as is shown in FIGS. 4 and 5. To reduce vacuum pressure loss, a gasket 72 seals the central frame 64 to the top 62 of the broom housing 34. The gasket 72 may be any suitable sealing material such as rubber or foam material, but is preferably a rubber/neoprene, blended foam material. Furthermore, the gasket 72 is preferably adhesively attached to the bottom 73 of the central frame 64 to prevent the gasket 72 from moving or shifting while mounting the vacuum assembly module 60 to the broom housing 34. By being secured to the central frame 64, the gasket is prevented from being lost, damaged or misplaced while mounting the vacuum assembly module 60 to other devices for other applications.

A fan 74 powered by and operably coupled to a fan motor 76 draws the air through the filter 68 by creating a vacuum or low pressure downstream of the filter 68. In the illustrated embodiment, the fan 74 is a centrifugal fan mounted directly to an output shaft of the fan motor 76 and positioned within a fan housing 75, which is provided in part by a portion of the central frame 64. Preferably, the fan 74 is a shrouded, backward inclined pressure fan. However, the present invention is not limited to a centrifugal fan as other fans and fan types may be used. Preferably, however, the fan 74 and fan motor 76 can move about between 900 and 1000 cubic feet of air per minute.

With reference to FIGS. 4 and 5, the fan 74 is circular and includes a top plate 77, a bottom plate 78 and a plurality of blades 79 secured therebetween. The bottom plate 78 includes a centralized hole in the bottom plate 84 of the fan housing 75 that exposes the blades 79 to an air inlet cavity 80 and allows air to enter the fan 74 proximate the center, as indicated by air flow arrows 81. As the fan 74 rotates, the spinning blades 79 grab and catch air from the air inlet cavity 80 proximate the center of the fan 74 and accelerate and push the air radially outward and out of the fan 74. The air exiting the fan 74 is forced out of the fan housing 75 through vents 82. The flow of air through the fan 74 and fan housing 75 creates a vacuum or low pressure zone on the downstream side of the filter 68 relative to the upstream side, i.e. broom housing 34 or inlet 70 side, of the filter 68. The pressure differential across the filter 68 causes air in the interior 66 of the broom housing 34 to flow generally through the inlet 70 in the central frame 64 and then through the filter 68.

Figure 6:
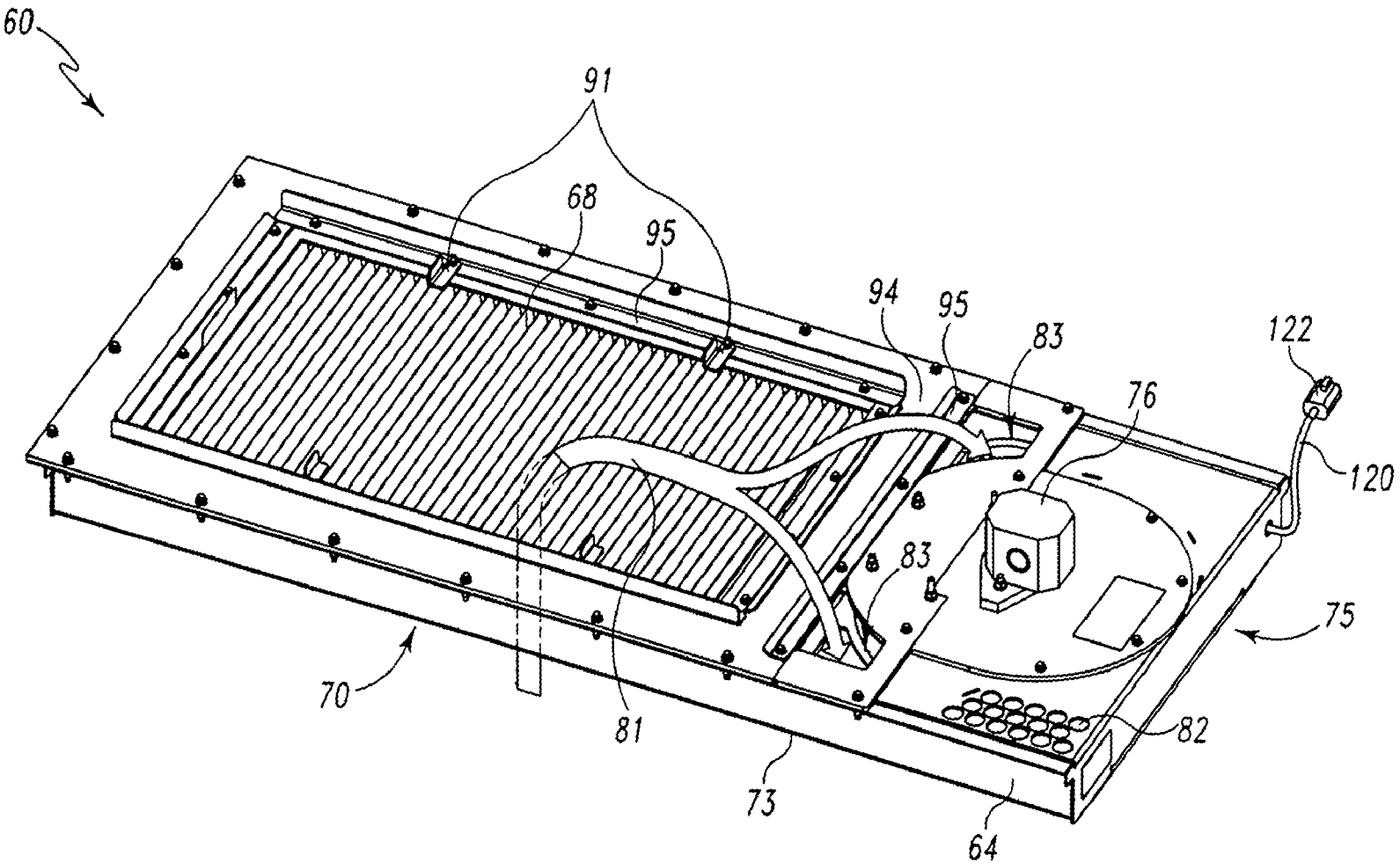
FIG. 6 is a partial perspective top view of the vacuum assembly module having the top cover and hinged door removed to expose the filter.

After passing through the filter 68, the filtered air passes across the top of the filter 68 toward air paths 83 and the fan housing 75, as illustrated by air flow arrows 81 in FIG. 6. After passing through the air paths 83, the air exits into the air inlet cavity 80 and flows towards the fan 74. In the illustrated embodiment, the air inlet cavity 80 is formed between a bottom plate 84 of the fan housing 75 and the top 62 of the broom housing 34. In another embodiment, the air inlet cavity 80 may include a bottom plate such that the air inlet cavity 80 is completely provided by the vacuum assembly module 60 without requiring interaction with the broom housing 34 or any other housing or device. The gasket 72 that seals the central frame 64 to the top 62 of the broom housing 34 to seal the inlet 70 further seals the air inlet cavity 80. The gasket 72 includes a cross member 85 to separate the inlet 70 from the air inlet cavity 80. After the clean air exits the air paths 83 into the air inlet cavity 80, the fan 74 draws the clean air through the hole in the bottom plate 84 of the fan housing 75 and through the hole in the bottom plate 78 of the fan 74, as explained previously and illustrated by air flow arrows 81.

The fan motor 76 can be any suitable motor for driving the fan 74 but is preferably powered by an auxiliary power source of the skid steer 20 such as a hydraulic, a pneumatic, or an electric system of the skid steer 20 that provides sufficient power to operate the fan motor 76. Preferably, the fan motor 76 is a hydraulic motor as most skid steers and other similar work machines have auxiliary hydraulic power supplies designed to power and operate similar attachments. In the illustrated embodiment, the fan motor 76 is powered by the same auxiliary power source and connected to the same power source output as the brush motor 53. The fan motor 76 is connected to the flow splitting manifold 57 by two power transmission lines 86, 87 such that the single output is shared by the brush motor 53 and the fan motor 76.

Figure 7:
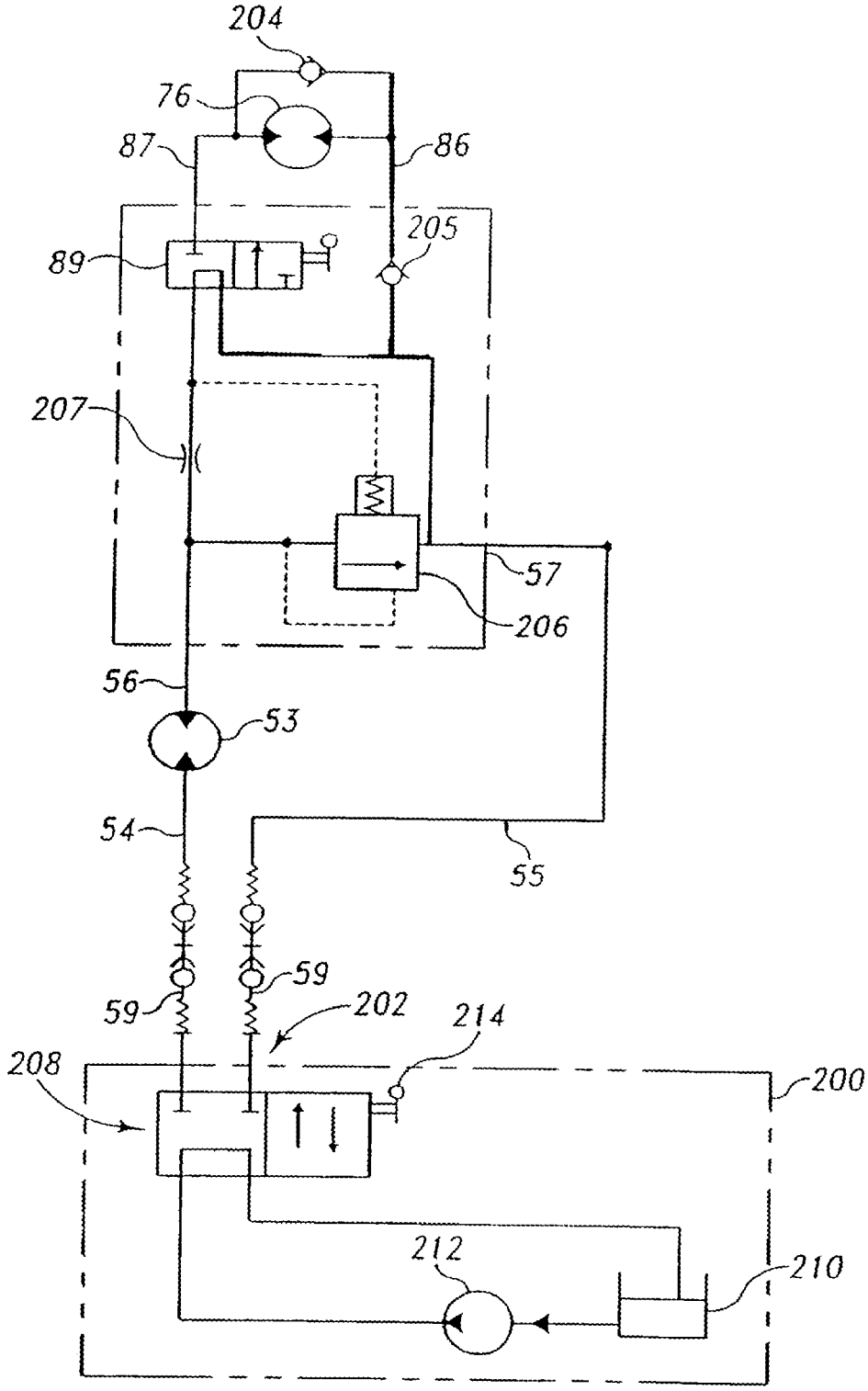
FIG. 7 is a simplified schematic illustration illustrating one embodiment of a hydraulic system for controlling the rotary broom attachment brush motor and the fan motor.

Turning to FIGS. 3 and 7, which illustrate in part the hydraulic circuit for operably powering the fan motor 76 and brush motor 53, power transmission line 54 connects the auxiliary power source 200 to the brush motor 53 through a quick connect connector 59. Power transmission line 56 connects the brush motor 53 to the flow splitting manifold 57. The flow splitting manifold 57 is mounted to the top of the vacuum assembly module 60 and includes a directional control valve having a switch 89 for selectively activating and deactivating the fan motor 76. With the fan motor 76 in the activated condition, fluid flows from the flow splitting manifold 57 through power transmission line 87 and then through the fan motor 76. As illustrated in FIG. 7, power transmission line 86 is directly interconnected between the fan motor 76 and the backside of the flow splitting manifold 57. In this configuration, after passing through the fan motor 76, the fluid exiting the fan motor 76 passes through power transmission line 86 and then through the flow splitting manifold 57. After passing through the flow splitting manifold 57, the fluid returns to the auxiliary power source 200 via power transmission line 55. The power transmission line 55, which is a return line, connects to the auxiliary power source 200 via another quick connect connector 59.

A check valve 204 arranged in parallel circuit with the fan motor 76 prevents shock loads from being induced on the fan motor 76. The check valve 204 is closed during normal operation and opens when the fan motor 76 is deactivated. The check valve 204 allows the fan 74 to free wheel and naturally come to a stop and prevents hydraulic fluid from reversing through the fan motor 76. A second check valve 205 is positioned within the flow splitting manifold 57 and is connected to the downstream side of the fan motor 76 to further prevent fluid from reversing through the fan motor 76 via power transmission line 86.

The flow splitting manifold 57 includes a flow restriction 207 to control the flow rate to the fan motor 76. The flow splitting manifold 57 further includes a logic element valve 206. The logic element valve 206 opens to allow hydraulic flow to bypass the fan motor 76 by sensing the pressure difference on either side of the flow restrictor 207. The logic element valve 206 communicates with power transmission line 55 to allow bypassing fluid to return to the auxiliary power source 200.

The auxiliary power source 200 of the skid steer includes a control valve 208, a reservoir or sump 210 and a hydraulic pump 212. The control valve 208 includes a control lever 214 positioned within the operator cabin 28 of the skid steer 20 that allows manual control over the control valve 208 to selectively activate and deactivate the rotary broom attachment 32, particularly the fan motor 76 and brush motor 53.

The flow splitting manifold 57 may not be necessary if the skid steer's auxiliary power source includes multiple outputs. In that situation, the brush motor 53 and fan motor 76 may be connected independently of one another to individual control valves.

In an embodiment, the vacuum assembly module 60 further includes a filter basket 90 that carries the filter 68. The filter basket 90 is preferably sized and configured for a removable snug fit receipt of the filter 68 to prevent dirty air and dust from short-circuiting the filter 68. As the filter 68 is removable from the filter basket 90, preferably, a plurality of clips 91 releasably secure the filter 68 within the filter basket 90 and provide tool-free securement of the filter 68. In an embodiment, the clips 68 are rotatable between a locked position where the filter 68 is secured in the filter basket 90 and an unlocked position where there filter 68 may be removed therefrom. In the locked position, as illustrated in FIG. 6, the clips 91 are rotated and positioned over the edges of the filter 68.

A pliable gasket 94, which can be a flexible membrane, connected to the filter basket 90 flexibly mounts the filter basket 90 to the central frame 64. A plurality of gasket mounting plates 95 help secure the pliable gasket 94 to the filter basket 90 as well as to the central frame 64 and distribute pressure across a larger area of the pliable gasket 94 to prevent tearing or deformation. The pliable gasket 94 suspends the filter basket 90 within the central frame 64 and proximate the inlet 70. Preferably, the pliable gasket 94 is a rubber or rubber-like material sufficient to provide a seal between the filter basket 90 and the central frame 64 to prevent unnecessary vacuum pressure loss or short-circuiting of dirty air. Other benefits of the flexibility of the pliable gasket 94 will be further explained and identified below.

A top cover 98 mounted to the top 102 of the central frame 64 further forms a portion of the air flow passage through which the filtered air travels. The pliable gasket 94 provides a seal and is secured between the central frame 64 and the top cover 98. The top cover 98 forms part of the low pressure zone on the downstream side of the filter 68. To provide access to the filter 68, the top cover 98 includes a hinged door 104 that can be opened for visual inspection and maintenance of the filter 68. The opening in the top cover 98, which is closed by the hinged door 104, is sized large enough for the filter 68 to pass therethrough. As the top cover 98 and hinged door 104 cooperate with the central frame 64 to provide a portion of the sealed air flow passage between the fan 74 and the filter 68, a door gasket 108 (see FIG. 3) seals the hinged door 104 to the outer surface of the top cover 98.

Latches 106 maintain the hinged door 104 in a closed condition. In an embodiment, the latches 106 are formed from a resilient flexible rubber material and stretch to engage a clip on the hinged door 104.

In an embodiment, the vacuum assembly module 60 includes a vibrator 116. The vibrator 116 is connected to the filter basket 90 and communicates vibrations to the filter 68 therethrough. The vibrator 116 is mounted to a rod 118 that is connected to the filter basket 90. Activation of the vibrator 116 translates vibrations to the filter 68 to dislodge a portion of the filtered particulates from the filter 68. This provides a temporary cleaning of the filter 68 allowing extended operation of the vacuum assembly module 60 between required maintenance of the filter 68. Preferably, with the fan motor 76 deactivated, the vibrator 116 may be activated dislodging filtered dust from the filter 68 such that it falls downward and into the bucket 44. Alternatively, while the bucket 44 is being emptied of debris 40 collected from sweeping, as illustrated in FIG. 2, the vibrator 116 may be activated to dislodge dust from the filter 68.

The vibrator 116 typically includes a rotating motor having an off-center weight making the vibrator 116 out of balance causing it to shake and vibrate when rotated, which in-turn, vibrates and shakes the filter basket 90 and consequently the filter 68. In an embodiment, the motor 116 of the vibrator is preferably powered by an electrical power source of the skid steer. In another embodiment, the motor of the vibrator 116 is powered by the same power source as the fan motor 76. However, it will be appreciated that the vibrator could be powered by any available power source provided by the skid steer 20 such as pneumatic, hydraulic or electric power sources. The vibrator 116 is connected to the electrical power source of the skid steer by power transmission line 120 that preferably includes a quick connect connector 122. In an embodiment, the vibrator 116 can be activated independently from the fan motor 76, particularly because the vibrator 116 will typically only be activated for brief periods of time and will not be activated during the majority of the sweeping, and as mentioned previously, it is preferable to only activate the vibrator 116 with the fan motor 76 deactivated. Furthermore, in an embodiment, when the vibrator 116 is activated, the fan motor 76 automatically deactivates to prevent activation of the vibrator 116 while the fan motor 76 is activated. In an embodiment where the vibrator 116 and the fan motor 76 are hydraulically powered, the hydraulic system powering the motors 76, 116 may incorporate reverse flow technology that effectuates the automatic deactivation of the fan motor 76.

In this embodiment, the pliable gasket 94 beneficially insulates and isolates the vibrations of the vibrator 116 from the rest of the vacuum assembly module 60 as well as the rest of the rotary broom attachment 32.

Figure 8:
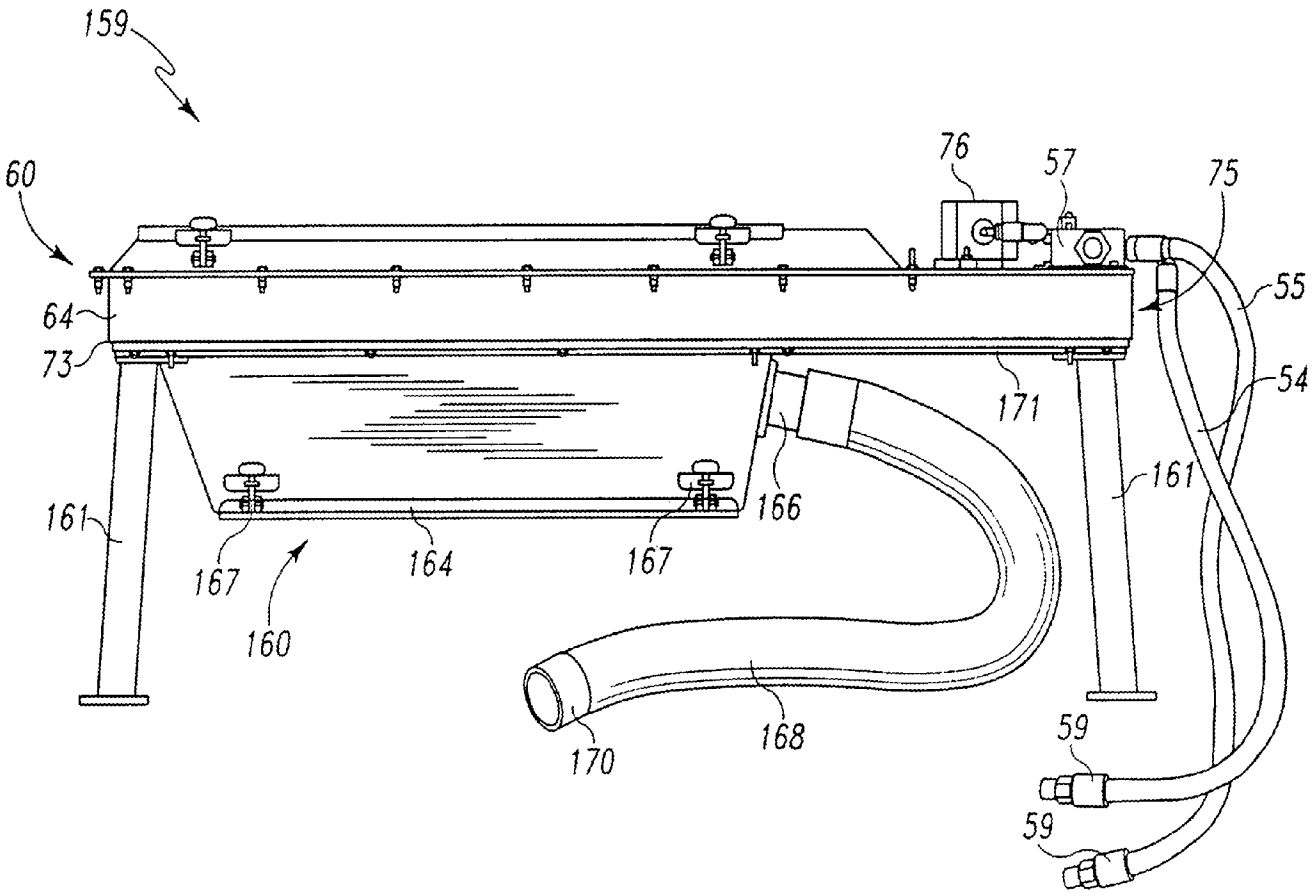
FIG. 8 is a front profile view of the vacuum assembly module functioning as an industrial vacuum having the vacuum assembly module secured to a pair of support legs and a debris collection bin.
Figure 9:
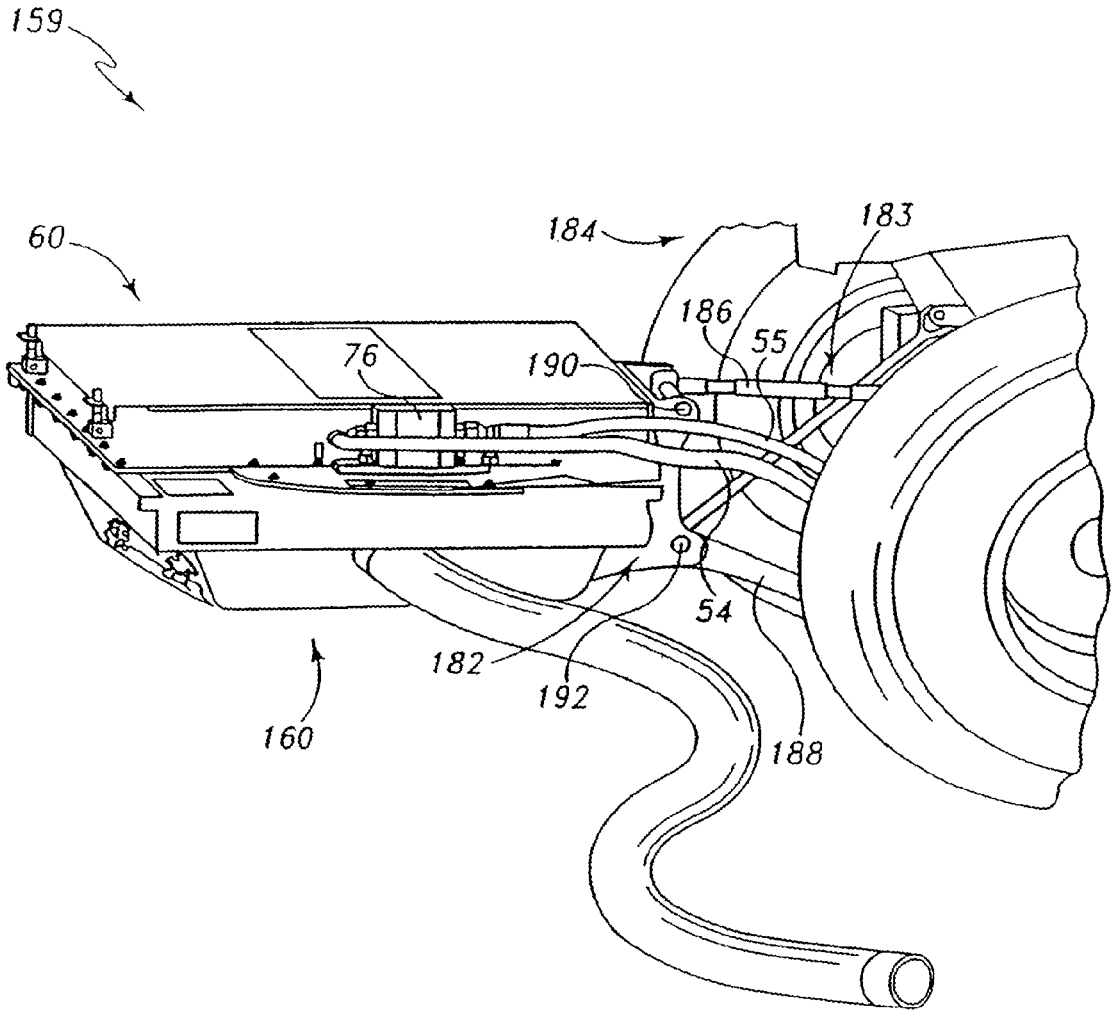
FIG. 9 is a perspective view of the vacuum assembly module functioning as an industrial vacuum that is mountable to a work machine.

FIGS. 8 and 9 illustrate several other applications of the vacuum assembly module 60 provided by the self-supported configuration. Particularly, the vacuum assembly module 60 may function as an industrial vacuum 159 independently or as incorporated into some other form of work attachment that generates dust. As is illustrated in FIG. 8, the vacuum assembly module 60 is configured as a stand alone industrial vacuum 159. The vacuum assembly module 60 is connected to a debris collecting bin 160 and a plurality of support legs 161.

The debris collecting bin 160 and support legs 161 mount to the bottom side 73 of the central frame 64. The support legs 161 support the combination of the vacuum assembly module 60 and the debris collecting bin 160. The debris collecting bin 160 collects debris vacuumed by the vacuum assembly module 60 and functions much like the broom housing 34 and bucket 44 of the skid steer 20, as previously disclosed and described. Thus, the debris collecting bin 160 is positioned proximate and below the inlet 70 of the central frame 64. The debris collecting bin 160 collects the larger debris drawn in by the vacuum assembly module 60 and any dust that may be dislodged from the filter of the vacuum assembly module 60 when the vibrator is activated.

The debris collecting bin 160 includes a hinged door 164. The hinged door 164 allows for the debris collecting bin 160 to be emptied and is secured in a closed condition by latches 167. Preferably a seal is provided between the hinged door 164 and the debris collecting bin 160 to prevent any vacuum pressure loss.

A hose connector 166 passing through a side wall of the debris collecting bin 160 is in fluid communication with the interior of the debris collecting bin 160 and allows a flexible hose 168 to be connected thereto. The flexible hose 168 may be any commercially available flexible vacuum hose and is preferably manufactured from plastic. Furthermore, the flexible hose 168 preferably includes a connector 170 for connecting additional attachments to the hose such as nozzles, brushes, hose extensions, and the like. To allow the vacuum assembly module 60 to function as the stand alone industrial vacuum 159, a plate 171 must be added below fan housing 75 to seal the air inlet cavity 80, as explained previously.

In this configuration, power transmission lines 54, 55 and connectors 59 may connect the fan motor 76 to any available auxiliary power source. Typically, this will be a tractor or skid steer. However, a stand alone power supply may be provided to power the fan motor 76 when a separate work machine is not available. Furthermore, an electric power source must be provided to activate the vibrator. Typically, this will be a 12 volt direct current power supply such as a battery of a vehicle, the skid steer, or another piece of work equipment.

The stand alone industrial vacuum 159 may further include a vehicle mount 182, as illustrated in FIG. 9. The vehicle mount 182 increases the portability of the stand alone industrial vacuum 159. The vehicle mount 182 allows the stand alone industrial vacuum 159 to be supported by a work vehicle, such as tractor 184 or a skid steer. This configuration makes the unit portable and easy to maneuver around a jobsite. With the stand alone industrial vacuum 159 attached to the tractor 184, the support legs 161 can be removed to prevent damage thereto. Furthermore, when it is necessary to remove the stand alone industrial vacuum 159 from the tractor 184, the support legs 161 may be reattached.

In the illustrated embodiment, the vehicle mount 182 secures the stand alone industrial vacuum 159 to the three-point hitch 183 of the tractor 184. The three-point hitch 183 functions to allow attachments connected thereto to be raised and lowered. The three-point hitch 183 includes an upper support arm 186 and a pair of laterally spaced apart lower lifting arms 188. The lower lifting arms 188 can be controlled to raise and lower the stand alone industrial vacuum 159. The upper support arm 186 functions to stabilize the stand alone industrial vacuum 159.

The upper support arm 186 connects to an upper pivot 190 of the vehicle mount 182 and the lower lifting arms 188 connect to lower pivots 192 of the vehicle mount 182. Preferably, the upper and lower pivots 190 and 192 are in the form of removable pins for easy connection to the upper support and lower lifting arms 186, 188, respectively. The vehicle mount 182 is connected to the debris collecting bin 160 of the stand alone industrial vacuum 159. By having the vehicle mount 182 attached to the debris collecting bin 160, the vacuum assembly module 60 can be removed for use in other situations, such as with the rotary broom attachment 32 previously described.

The stand alone industrial vacuum 159 was described with reference to mounting to a tractor 184 via a three-point hitch connection. However, the vehicle mount 182 of the vacuum assembly module could be replaced by other mounting structure to mount the industrial fan to other work machines such as the skid steer disclosed previously. Particularly, the vehicle mount 182 could take the form of the mounting structure for securing a bucket or other attachments to the skid steer.

From the foregoing, it is apparent that the present invention has many beneficial aspects. First, the vacuum assembly module may be used to provide dust reduction capabilities to a rotary broom attachment or other work machine attachments by replacing the cumbersome water misting devices. Second, the vacuum assembly module may be used to retrofit existing rotary broom attachments or may be manufactured with the rotary broom attachment. Furthermore, the present invention may be adapted to provide an industrial vacuum.

All references, including publications, patent applications, and patents cited herein, are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vacuum assembly module attachment for a work machine attachment for a work machine having at least one auxiliary power source, the work machine attachment performing an end function for the work machine, the work machine attachment having a housing in which the end function for the work machine is performed, the module comprising:

a frame structure including an air flow passage extending between an inlet and an outlet;

a filter supported by the frame structure and arranged relative to the air flow passage to remove dust particulate from air passing therethrough;

a fan supported by the frame structure mounted within a portion of the air flow passage arranged to move the air through the air flow passage between the inlet and the outlet;

a motor supported by the frame structure and operably coupled to the fan;

wherein the frame structure, the fan, the filter and the motor, together, form a self-supported module apart from the work machine and apart from the work machine attachment, mountable to the work machine attachment, the module requiring an external power source to power the motor; and at least one power transmission line to operably releasably connect the module to a power source external to the module to power the motor during operation of the module; and further comprising a seal surface facing away from the frame structure and exposed to sealingly mount the vacuum assembly module attachment to the housing of the work machine attachment, the seal surface surrounding the inlet.

2. The vacuum assembly module attachment of claim 1, further comprising a vibrator supported by the frame structure and acting on the filter to operably shake the filter.

3. The vacuum assembly module attachment of claim 1, wherein the at least one power transmission line is selected from the group consisting of a hydraulic line, a pneumatic line or an electrical cord to operably releasably connecting the module to a power source provided by the work machine to power the motor.

4. The vacuum assembly module attachment of claim 1, wherein the seal surface is provided by a seal member in the form of a gasket, the gasket having a mounting surface opposite the sealing surface, the mounting surface facing the frame structure and fixedly mounted thereto, such that the gasket is compressed between the frame structure and the work machine attachment when mounted thereto.

5. A vacuum assembly module attachment for a broom attachment for a work machine, the broom attachment having a housing, the module comprising:

a frame structure including an air flow passage extending between an inlet and an outlet;

a filter supported by the frame structure and arranged relative to the air flow passage to remove dust particulate from air passing therethrough;

a fan supported by the frame structure mounted within a portion of the air flow passage arranged to move the air through the air flow passage between the inlet and the outlet;

a motor supported by the frame structure and operably coupled to the fan;

wherein the frame structure, the fan, the filter and the motor, together, form a self-supported module apart from the work machine and apart from the broom attachment, mountable to the broom attachment; and at least one power transmission line to operably releasably connect the module to a power source provided by the work machine; and further comprising a seal surface facing away from the frame structure and exposed to sealingly mount the vacuum assembly module attachment to the broom attachment, the seal surface surrounding the inlet.

6. The vacuum assembly module attachment of claim 5, further comprising a power splitting device operably interposed between the motor and the at least one power transmission, the power splitting device configured such that the power source provided by the work machine can be used to power the motor as well as another mechanism.

7. The vacuum assembly module attachment of claim 5, further comprising a vibrator supported by the frame structure and acting on the filter to operably shake the filter.

8. The vacuum assembly module attachment of claim 7, further including at least one power transmission line having a quick connect connector to releasably connect the vibrator to an auxiliary power source.

9. The vacuum assembly module attachment of claim 5, wherein the at least one power transmission line is selected from the group consisting of a hydraulic line, pneumatic line or an electrical cord.

10. The vacuum assembly module attachment of claim 5, wherein the fan can move at least 900 cubic feet of air per minute.

11. The vacuum assembly module attachment of claim 5, wherein the module requires connection to an external power source during operation of the motor.

12. A vacuum assembly module attachment for a broom attachment for a work machine, the broom attachment having a housing, the module comprising:

a frame structure including an air flow passage extending between an inlet and an outlet;

a filter supported by the frame structure and arranged relative to the air flow passage to remove dust particulate from air passing therethrough;

a fan supported by the frame structure mounted within a portion of the air flow passage arranged to move the air through the air flow passage between the inlet and the outlet;

a motor supported by the frame structure and operably coupled to the fan;

wherein the frame structure, the fan, the filter and the motor, together, form a self-supported module apart from the work machine and apart from the broom attachment, mountable to the broom attachment; and at least one power transmission line to operably releasably connect the module to a power source provided by the work machine; and wherein a seal surface is provided by a seal member in the form of a gasket, the gasket having a mounting surface opposite the sealing surface, the mounting surface facing the frame structure and fixedly mounted thereto, such that the gasket is compressed between the frame structure and the broom attachment when mounted thereto.

13. A vacuum assembly module attachment for a work machine attachment for a work machine, the work machine attachment having a housing, the module comprising:

a frame structure including an air flow passage extending between an inlet and an outlet;

a filter supported by the frame structure and arranged relative to the air flow passage to remove dust particulate from air pan therethrough a fan supported by the frame structure mounted within a portion of the air flow passage arranged to move the air through the air flow passage between the inlet and the outlet;

a motor supported by the frame structure and operably coupled to the fan;

wherein the frame structure, the fan, the filter and the motor, together, form a self-supported module apart from the work machine and apart from the work machine attachment, mountable to the housing of the work machine attachment; and at least one power transmission line having a quick connect connector to operably releasably connect the motor to a power source provided by the work machine; and wherein the inlet is in fluid communication with the interior of the housing of the work machine attachment.

14. The vacuum assembly module attachment of claim 13, wherein the filter is mounted in a flexible membrane connected to the frame structure.

15. The vacuum assembly module attachment of claim 13, wherein the filter is washable and the filter media includes polytetrafluoroethylene.

16. The vacuum assembly module attachment of claim 13, wherein the at least one power transmission line is selected from the group consisting of a hydraulic line, pneumatic line or an electrical cord.

* * * * *

UNITED STATES PATENT AND TRADEMARK OFFICE

CERTIFICATE OF CORRECTION

PATENT NO. : 7,958,596 B2
APPLICATION NO. : 12/325626
DATED : June 14, 2011
INVENTOR(S) : Randall Craig Torno It is certified that error appears in the above-identified patent and that said Letters Patent is hereby corrected as shown below:

In column 14, line 8, “pan therethrough” should be -- passing therethrough; --.

Signed and Sealed this
Nineteenth Day of July, 2011

David J. Kappos

David J. Kappos
*Director of the United States Patent and Trademark Office*